United States Patent [19]

Hendricks et al.

[11] 4,032,038

[45] June 28, 1977

[54] DEVICE, APPARATUS AND PROCESS FOR DISPENSING TAPED BAGS

[75] Inventors: David Allen Hendricks; Milton Albert Howe, Jr., both of Spartanburg; Stephen Royall Luck, Greenville, all of S.C.; Alfred Ray Morris, Cedar Rapids, Iowa; Dave Leslie Owen, Wellford, S.C.

[73] Assignee: W. R. Grace & Co., Duncan, S.C.

[22] Filed: Jan. 29, 1976

[21] Appl. No.: 653,420

[52] U.S. Cl. ..... 221/71

[51] Int. Cl.[2] ..... B65H 19/12

[58] Field of Search ..... 206/460, 389; 229/69; 221/71–74; 194/4, DIG. 26; 271/151

[56] References Cited

UNITED STATES PATENTS

| | | | |
|---|---|---|---|
| 490,019 | 1/1893 | Hawk et al. | 221/72 X |
| 3,146,149 | 8/1964 | Silverstein | 221/73 X |

*Primary Examiner*—Stanley H. Tollberg
*Attorney, Agent, or Firm*—John J. Toney; William D. Lee, Jr.; John B. Hardaway

[57] ABSTRACT

A device useful for dispensing taped bags includes spaced apart rotatably mounted carriers, a surface therebetween to wind up at least one tape, and a clutch assembly for unidirectional rotation of the wind up surface. In various embodiments, the device further includes a variety of features which facilitate removal of wound up tape, such as a spring which is compressible to provide a clearance, a pin to permit rotation of the wind up surface away from a carrier plate, use of spaced apart flexible rods as the surface whereby the free ends of the rods may be compressed to reduce the surface perimeter, and forming the surface of low friction material. The device is especially useful when used as a component of apparatus having a housing for supporting a supply of taped bags.

Also provided is a process useful for removing flexible receptacles such as bags from a chain having at least one bag-connecting tape, which includes securing the tape to a reel, rotating the reel to (a) withdraw the leading bag from a supply, (b) wind up a portion of the tape, and (c) create tension on the tape, manually removing at least the leading bag from the tensioned tape, repeating the two preceding operations, and thereafter removing the resulting accumulated tape.

The device and apparatus may be operated and the process may be carried out in simple, efficient, manual manner without requiring costly or complex power components.

16 Claims, 20 Drawing Figures

DEVICE, APPARATUS AND PROCESS FOR DISPENSING TAPED BAGS

The present invention relates to a device useful for winding up flexible material, for example tape, and thereafter removing the accumulated wound up material. The invention further relates to a dispensing system including the device as a component thereof and to a process for sequentially removing flexible receptacles from a chain wherein the receptacles are successively adhered to at least one tape.

Packaging plays an important role in the economy. The ultimate cost of packaged goods to the consumer depends on the availability of low cost efficient packaging method and devices, including auxiliary components used in packaging. A variety of consumer products, including meat, are packaged in bags supplied as a chain of imbricated taped bags wherein the bags are adhered to one or more strands of tape. Imbricated bags are disclosed in U.S. Pat. Nos. 3,587,843 (Wing) and 3,698,547 (Roberts). Also disclosed therein are tape pulling units for automatically dispensing taped bags. Becht, U.S. Pat. No. 3,702,672, discloses an arcuate head and friction bar which allegedly aid in manually dispensing plastic bags from a perforated roll. Sebring, U.S. Pat. No. 3,554,447, discloses use of a stripper plate for detaching envelopes from a carrier web. U.S. Pat. No. 3,918,661 (Kishi et al.) discloses a paper roll holder having a lid mounted to abut on the roll.

Although large volume packagers can advantageously utilize automated dispensing systems for taped bags, there is a substantial need in the art for manually operable taped bag dispensing units and processes, especially for lower volume taped bag users. Heretofore known dispensing devices and processes have not entirely satisfactorily satisfied this need. It has now been found by practice of the present invention that numerous deficiencies of the prior art are overcome in simple, efficient and economical manner.

Generally stated, in one aspect of the present invention there is provided a device, useful for winding up a flexible material and developing tension thereon, comprising:

a. a carrier,
b. means for rotatably mounting the carrier to permit rotation of the carrier about an axis of rotation,
c. means defining a surface adapted to rotate in response to rotation of the carrier to wind-up at least one flexible support, and
d. means for permitting rotation of the surface in a first rotational direction and for substantially precluding rotation of the surface in a direction opposite to the first direction.

In another aspect the present invention provides an apparatus comprising the device in combination with a housing adapted to support a supply of receptacles removably attached to at least one flexible support, for example, one or more strands of tape.

In another aspect, the device of the present invention includes a frame, a carrier connected to the frame, and an annular member encircling the carrier and rotatably supported by the carrier for rotation of the annular member about the carrier.

Further provided by anohter aspect of this invention is a chain including:

A. a flexible support having an end portion,
B. a plurality of articles removably secured to said flexible support and successively disposed thereon, and
C. winding and holding means secured to said end portion for winding said flexible support into a wound position about said means and for holding a so wound portion of said flexible support under sufficient tension such that one or more of said articles may be removed from the wound portion of the flexible support by hand grasping and pulling the article to be removed.

In another aspect, generally stated, the invention provides a process for sequentially removing flexible receptacles from a chain of the receptacles adhered to at least one flexible support, which includes:

A. withdrawing a portion of the flexible support from a supply,
B. securing the withdrawn portion to a wind up surface,
C. rotating the surface when the flexible support is secured thereto to
   a. withdraw a chain portion including at least one receptacle from the supply,
   b. wind up a portion of the flexible support, and
   c. create tension on the withdraw chain portion including at least one receptacle,
D. while the chain portion is under the tension, removing at least one receptacle from the tensioned chain portion,
E. repeating steps (C) and (D) for successive portions of the chain to sequentially remove a plurality of the receptacles, thereby accumulating a wound-up flexible support portion, and
F. removing the accumulated flexible support portion from the wind up surface.

The present invention will become more fully apparent by having reference to the accompanying drawings wherein similar elements are identified by like numerals throughout.

Figure 1:
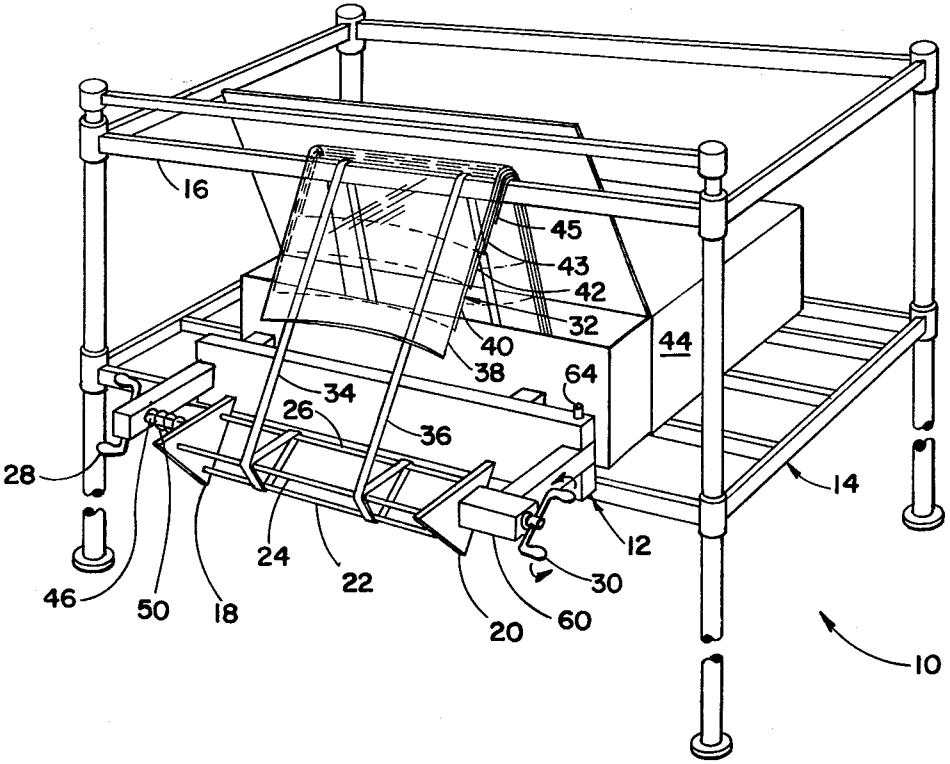
FIG. 1 is a perspective view illustrating the apparatus of this invention, including the device as a component thereof.
Figure 2:
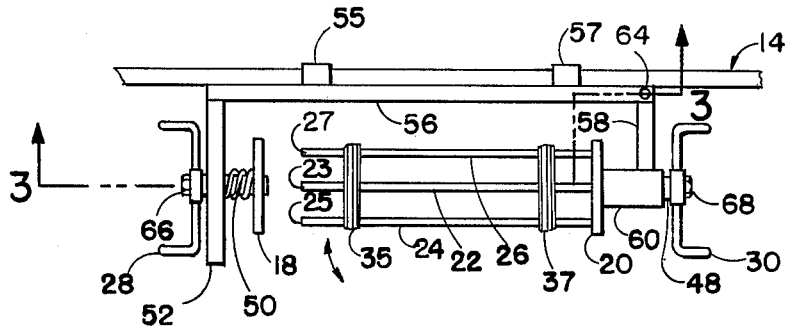
FIG. 2 is a plan view of the apparatus showing the device connected to the apparatus housing with part of the housing removed.
Figure 3:
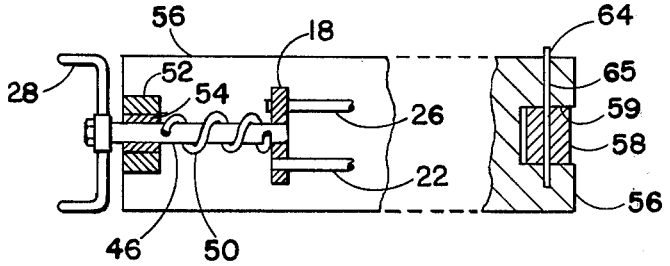
FIG. 3 is an elevation view of the device, illustrated in fragmentary section taken along the line 3—3 of FIG. 2.

Referring now to the drawing, and particularly FIGS. 1–3 thereof, there is illustrated dispensing apparatus 10 including reel device 12 mounted on housing 14 which supports box 44 containing supply chain 32 of imbricated flexible receptacles, which may be bags. The dispensing apparatus may include support member 16 as a component of the housing as desired.

The device includes spaced apart opposite carriers illustrated by plates 18 and 20, which are mounted on rotatable shafts 46 and 48 to permit rotation of the carriers or plates about an axis of rotation. As illustrated the axis of rotation for the carriers is the axis of rotation of the shafts. Other axes of rotation for the carriers may be employed. For example, the carrier plates may be connected to the shafts by means of intermeshing drive and follower gears, whereby the axis of rotation for the carrier plates is generally parallel to and spaced from the axis of rotation of the shafts. Suitable gear arrangements to perform this function are well known in the art. The plurality of rods, illustrated by spaced apart rods 22, 24 and 26, are received at opposite ends thereof by the respective carrier or plate. The rods define a surface adapted to rotate, preferably about the rotational axis of the plates. The surface is further adapted to wind up at least one and preferably at least two tapes, illustrated by tapes 34 and 36 of the chain of imbricated bags.

In the embodiment illustrated in FIG. 1 the surface is an elongate generally triangular prism, the apexes of which are the outer arcuate surfaces of the rods, that is the arcuate or curved surface segments of the rods disposed radially outwardmostly from the axis of rotation which coincides with the coaxial axes of the shafts. The surface is further illustrated in FIG. 7 by perimeter 70, which is representative thereof and also representative of the inner surface of tape wound up in spiral or convolute manner as shown by tape accumulation 35 in FIGS. 1, 2 and 7. Although the preferred surface is an open surface having openings or discontinuities defined by the gaps or spacings between the rods along the legs of its triangular section (taken normal to the axis), continuous perimeter surfaces are also suitable in the present invention. As described in greater detail below, the surface may be for example a closed surface of cylindrical or other shape. Upon rotation of the plates, the wind up surface rotates and, when the tape is secured to the rods, withdraws a portion of the chain of imbricated bags and winds up the tape as shown by tape portions 35 and 37 in FIG. 2.

Rotation of the carriers and the wind up surface may be conveniently effected, without requiring powered drives, by manually turning handle 28 mounted on shaft 46 and/or handle 30 mounted on shaft 48. Although one handle is typically sufficient, provision of a handle at each opposite end increases the versatility of the device by providing the operator thereof with an optional choice of locations for positioning himself and reaching the handles.

The means for rotatably mounting the plates 18 and 20 in the illustrated embodiment having shafts 46 and 48 further includes shaft supporting members illustrated by arms 52 and 58, which may be connected at ends thereof to generally elongate body 56. As shown at the left side of FIG. 3 shaft 46 extends through arm 52 and is mounted therein against bearing 54 disposed intermediate the shaft and the arm.

In another embodiment device 12 may be formed of the above-described construction except omitting handle 28, arm 52, shaft 46, spring 50, and optionally omitting carrier 18, all appearing at the left side of the device in FIG. 1. However, where the support surface is of decreasable perimeter, for example the rods are flexible, it is preferable in this embodiment to include carrier 18 for improved stability of the wind up surface. If desired, the carrier may be removably secured to the rods, preferably by quick-release fastening means (not shown). A number of such means are well known.

The body may be provided with suitable members for attachment of the device to a support therefor such as housing or framework 14, as shown in FIGS. 1 and 2. As shown in FIG. 1 the device may thereby be combined with a housing adapted to support a supply of receptacles removably attached to at least one strand to form an apparatus or dispensing system of which the device is a component. Preferably the system includes means for supporting the supply of imbricated bags adhered to a chain and further includes a support member for supporting and tensioning the chain to provide suitable tension on the tape portions extending from the support member, for example bar 16 (FIG. 1) included as a component of the framework or housing, and terminating to the wind up surface of the device. That is, the terminal portion of the tensioned tape is either on the wind up surface of the device per se or is a tape region connecting the tensioned tape portion to a wound up portion of the tape.

Figure 11:
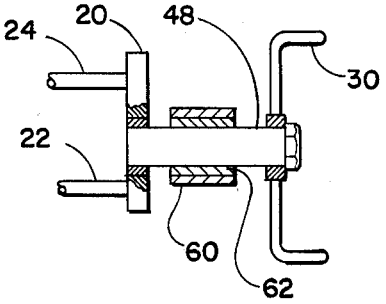
FIG. 11 is a fragmentary view, partially in section, illustrating a means for substantially unidirectional rotation of the device.

In the illustrated embodiment the means for rotatably mounting plate 20 includes shaft 48, which is connected to the plate by any suitable means such as a key and key ways disposed in the plate and shaft. Since numerous suitable connecting means are well known in the art, they are not shown in the drawing. The rotatable mounting means for shaft 48 further includes arm 58 which is connected to body 56 and spaced from arm 52. Arm 58 may either integrally include or have connected thereto clutch assembly 50 having clutch 62. The clutch assembly or other suitable means is provided for permitting rotation of the wind up surface in a first rotational direction and for substantially precluding rotation of the surface in the opposite rotational direction. As illustrated in FIG. 11, shaft 48 extends through the clutch assembly and is operatively connected to clutch 62 by means well known in the art. Clutches are well known in the art and accordingly are not described in greater detail in the drawings or this description. Other means, for example well known pawl and rachet assemblies may be used in combination with or in lieu of the clutch assembly for obtaining the described function thereof in the present device. The clutch assembly aids in maintaining a suitable amount of tension on the tapes 34 and 36 of the chain of imbricated bags such that when a bag is pulled, as by an operator, from the tapes the bag removal may be effected with minimum effort and without concern for disrupting the orderly arrangement of the chain of bags secured to the wind up surface of the device.

It will be appreciated by those skilled in the art having the benefit of this description that in some applications it will be permissible to include a clutch assembly or other suitable means which further permit the surface to rotate in a direction opposite to the wind up direction by a predetermined suitable amount but typically not more than said predetermined amount. Accordingly when the words "substantially precluding rotation" are used in the description of the function and operation of the clutch assembly, they are intended to be broad in scope, thereby including total preclusion and permissible opposite rotation up to a suitable predetermined amount.

The handles may be secured to their respective shafts by any suitable securing means, for example the shafts may have threaded regions proximate their ends engaged by fastening means such as nuts 66 and 68 as illustrated.

From the above description it will be apparent to those skilled in the art that the device as thus far described is eminently suitable for wind up operations where it is required to wind up a flexible member, such as tape or the like, and especially where it is further required that, when the winding up operation is temporarily suspended, the material next to be wound up be maintained under tension.

Ultimately of course it becomes necessary of desirable to begin a new winding operation. This necessitates typically either removal of the wind up surface having the tape or other material wound thereupon or removal of the accumulated tape from its wound up position on the winding surface. The embodiment device is also eminently suitable for aiding in removing wound up tape. The openings in the wind up surface between the rods suitably provide space wherein an operator may insert a knife and quickly and easily sever the accumulate tape through a width of the accumulation at one or more locations and next simply lift the severed tape from the wind up surface.

Additional features described and claimed herein further aid in performance of the often necessary step of removing tape from the wind up surface. These features, next described, have the additional advantage of not requiring use of hand tools or the like such as knives for removing wound up tape.

In another preferred embodiment, the device includes resilient or other means, illustrated by spring 50 disposed about shaft 46 and between arm 52 and plate 18. Such means permit relative displacement of the surface defining means, for example the rods 22, 24 and 26, away from plate 18 to provide clearance for removal of wound up tape accumulations 35 and 37. In FIGS. 1 and 3 the resilient member or spring 50 is shown in a normal extended position wherein the rods or surface defining means are in engagement with the plate 18 having holes therin for supporting and engaging the rods. When it is desired to remove the accumulated tape, the plate 18 may be merely pushed toward the carrier or arm 52 with sufficient force to compress the spring 50 as shown in FIG. 2, thereby providing clearance between the plate and the rod ends 23, 25 and 27. Thereafter the accumulated tape may be slid or otherwise passed along the rods, over the ends of the rods, and removed from the device through the clearance. To further aid in this removal operation, the wind up surface or rods preferably are of low friction composition. The material or composition with this low friction or high slip property may be, for example, fluorocarbon materials such as Teflon (DuPont trademark), which may be coated on an underlying rod of metal or other material having the desired degree or rigidity or may be the material of which the rod itself is formed.

Figure 7:
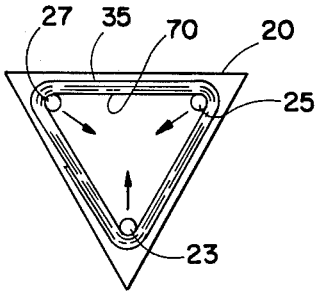
FIG. 7 is a side elevation view of the device with an accumulation of wound up tape thereon.
Figure 8:
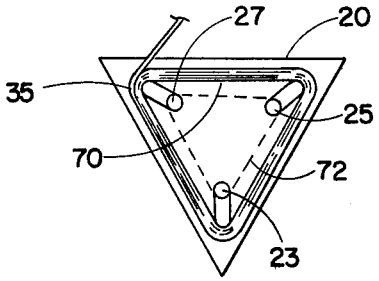
FIG. 8 is a side elevation view similar to FIG. 7 except illustrating a contracted perimeter of a portion of the device for facilitating removal of the wound up tape.

In another preferred embodiment, the wind up surface is adapted for contraction of its perimeter, preferably in a region of the surface proximate an end thereof, which may be the end adjacent a carrier having associated therewith a spring or other resilient means as described above. For example, where the wind up surface is provided by rods such as rods 22, 24 and 26, the rods are formed of flexible construction whereby, when clearance is provided between the rods and the carrier associated therewith, the rods may be squeezed by hand pressure or the like to decrease the normal or at rest surface perimeter 70, which typically corresponds to the inner surface of accumulated tape 35, to form a decreased perimeter 72 (FIG. 8) defined by the contracted rod arrangement. The inwardly directed arrows in FIG. 7 illustrate the squeezing operation schematically. The provision of flexible rods or other structure permitting contraction of the perimeter of the wind up surface is further advantageous in the event that, for example, operator error results in disorderly accumulation of wound up tape or misalignment of a chain of imbricated bags when such chain is being dispensed using the device. The operation may be temporarily shut down, the unsatisfactory accumulation may be quickly removed, the device restored to its operative wind up mode, and a new wind up operation begun.

Another optional but preferred feature of the present device is provided by pivotally mounting at least one of the carrier supports or arms to the body of the device or other member which supports the device in use. One means for pivotally mounting the device is illustrated in FIG. 2. As illustrated therein the body 56 is provided with a pin 64 extending through hole 65 thereof and received in a hole provided in arm 58. The body may be formed with recess 59 or other suitable means for permitting a suitable degree of pivotal motion of arm 58 and the device as a whole, relative to the normal or wind up position. The arcuate arrow in FIG. 2 schematically illustrates angular displacement of the wind up surface relative to carrier plate 18 in the plane of the drawing. The pivotal feature is especially desirable when the device is formed of highly compact construction with limited clearance providable by the above described use of the resilient or spring member. For example, after the spring is compressed as shown in FIG. 2, the surface of the device may be angularly displaced away from the carrier, thereby providing a larger clearance for removal of the accmulated tape around the rod ends.

Figure 9:
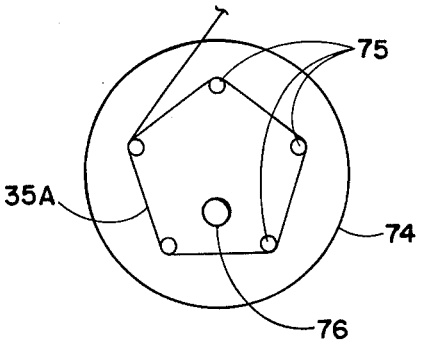
FIG. 9 is a side elevation view of a portion of another embodiment of the device with a different wind up surface.

The carriers or plates may be of any suitable shape, for example triangular as shown by plates 20 and 18 in FIGS. 1, 2, 7 and 8, circular as shown by plate 74 in FIG. 9, rectangular as shown by plate 78 in FIG. 11, or other suitable shape, regular or irregular as desired.

Figure 10:
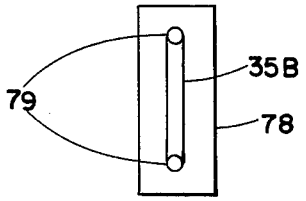
FIG. 10 shows still another embodiment of the wind up device in side elevation view.

The wind up surface defined by surface defining means may likewise be of any suitable shape, including a continuous or discontinuous triangular prism as illustrated in FIGS. 1, 2, 7 and 8, or any other suitable continuous or discontinuous cylindrical or polygonal prism shape. For example the surface may be a generally rectangular prism as indicated in cross section in FIG. 10, wherein the wind up surface is illustrated by perimeter 35B of a tape wound up about the surface defined by two rods 79 received in carrier plate 78, which may be fixed on a shaft in the plate-to-shaft arrangement described above. Other polygonal prismatic shape wind up surfaces suitable herein are regular or irregular quadrangular and pentagonal surfaces, for example the regular pentagonal discontinuous surface provided by pentagonally arranged rods 75 received in plate 74 (FIG. 9), wherein the wind up surface is schematically illustrated by the wound up tape 35A.

If desired the surface may be a continuous surface provided by placing a sleeve about the rods or other supporting members in any of the above described rod arrangements. The carrier plates may be mounted for eccentric rotation about an offset shaft such as eccentric shaft 76 shown in FIG. 9.

The rods may be connected to the plates in an offset manner such that the wind up surface defined by the rods rotates about an axis other than the rotational axis of the plate or plates. Means for such offset connection are well known in the art, for example gear trains, and are not illustrated in the drawings hereof.

Figure 4:
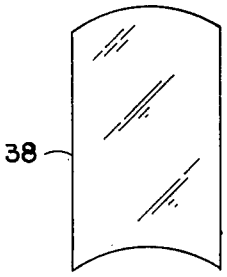
FIG. 4 is a plan view of a flexible receptacle which can be efficiently removed using the present invention.
Figure 5:
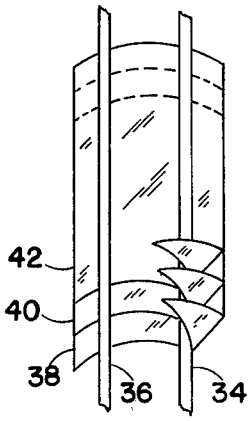
FIG. 5 is a plan view of a chain of imbricated flexible receptacles, each secured to at least one strand of tape and suitable for use in the present invention.

As indicated above the present device and apparatus or dispensing system including the device as a component thereof are eminently suitable for use in dispensing a bag or other receptacle from a chain of a plurality of imbricated bags such as those arranged along the two strips of adhesive tape 34 and 36 (see FIG. 1). The chain of imbricated bags 32 may be made up of numerous individual bags, illustrated by bags 38, 40, 42, 43 and 45, in FIGS. 1, 5 and 6. These bags are adhered to the two parallel and spaced apart tacky tapes. The tapes may be seen in FIG. 1 in operative engagement on the device, pulled down and looped about the wind up surface thereof. Preferably the chain of bags extends over a support member illustrated by bar 16 which may be a component of the housing 14 if desired, and down into box 44. Each or any of the bags may be generally rectangular, with or without one or more arcuate ends as shown by bag 38 in FIG. 4. The bags are offset from one another along the tape or tapes as illustrated in FIG. 5, which shows offset bags 38, 40 and 42 secured to tapes 34 and 36 as they appear looking upwardly in FIG. 1. For greater clarity the bags are shown in FIG. 5 with corners thereof folded back in overlapping fashion, although such arrangment is not required for suitable operation of the present device or for carrying out the present process.

Figure 6:
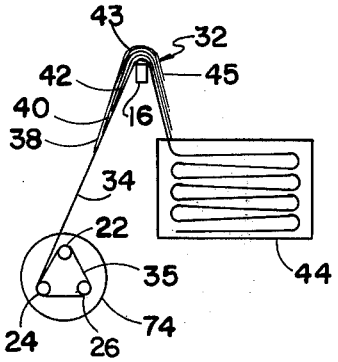
FIG. 6 is a side elevation view schematically illustrating the chain of imbricated flexible receptacles of FIG. 5 when being despensed using the present device and/or process.

FIG. 6 schematically illustrates the chain of imbricated bags 32 withdrawn from box 44 having a supply of the chain in zigzag configuration. The chain extends upwardly over support bar 16 and down to and wound about rods 22, 24 and 26 received in carrier plate 74. The drawing merely schematically shows the arrangement of bags 38, 40, 42, 43 and 45 and for purposes of illustration exaggerates the typical height of any bag above the tape in the unattached regions and the typical gentle reversal of direction of the bags as they pass over the support bar.

The present device and apparatus may be formed entirely of metal or of any combination of suitable materials using well known forming procedures therefor.

Imbricated bags on tapes are described in detail in U.S. Pat. No. 3,587,843 (Wing). A typical chain is next described. The tapes 34 and 36 are spaced apart on the imbricated bags about one-fourth the width of the bag in from each side within a tolerance of preferably one-eighth of the width of the bag so that the bags may be readily handled and removed by an operator. The tapes are spaced inwardly from their respective sides about an equal distance. The tolerance for the equal inward spacing is about ½ inch if the bags are to be optimally pulled into position for bag removal with the open end evenly aligned. For example the bag as shown in FIGS. 4, 5 and 6 may be 12 inches wide, the tapes may be 5 and ½ inches from inside edge to inside edge and the tapes may be about ¾ inch wide. The distance from the outside edge of each tape to the nearest side edge of the bag may be about three inches. The bags may be offset from one anoher along the tape ¾ inch. The tape contact surface may be 1⅛ square inches on each bag, 9/16 square inch contact surface per tape. The tape contact surface per tape may vary, for example from ¼ to 1 square inch per tape. The tack strength should be such that from 2 to 4 pounds, preferably about 2 pounds, force will separate the bag from the tapes. As a genreal preference tack strengths of less than 2 pounds, e.g. 1 or ½ pounds will not separate the bag from the tapes when the pull is provided at an angle of 30° in the direction toward which the bags are normally stripped from the tapes. If a high tack tape is used the width of tape and the area of contact desirably is reduced. The tensile strength of the tape preferably is maintained above 25 pounds per tape and preferably about 55 pounds per tape. In order that the tapes not cause the lead bag to trough or curve side edge to side edge when tape wind up is initiated, the tape extends 18 inches beyond the lead bag in the chain.

If the surfaces of the bags tend to adhere together a dusting of talc to cover the surfaces of the bags inside and out may be used to overcome the sticking together of the bag surfaces.

In operation, according to a preferred form hereof, an operator places a box or other supply chain of imbricated bags on a platform of the housing 14 and initially withdraws a leading end of the chain from the supply. The leading end of tapes 34 and 36 are pulled up and over bar 16 and down to the wind up rods or other wind up surface. Preferably, the tapes are tack-free on the exposed surfaces shown in FIG. 5. The leading tape ends are wound around the rods and overlying convolutions of each tape may be secured to the underlying tape convolutions by a slight pressure, whereby the tacky tape surface adheres to an adjacent tack-free convolution thereby securing the tapes to the wind up surface of the device. Other suitable securing methods may be used.

After the tape is secured to the surface, the handle may be manually rotated by the operator to effect withdrawal and wind up of additional chain portions as may be required to advance at least the leading receptacle from the supply. If the amount of leading tape portions initially withdrawn is of sufficient length, the leading receptacle and successive bags may already have been pulled over the bar. A sufficient amount of tape is wound up such that at least one and preferably a plurality of bags is displayed for subsequent removal from the tape, typically in a display area defined by the tape run from the wind up surface to the bar. Some winding up, as by turning the handle or handles, may be required to create suitable tension on the tape portion having bags secured thereto in the display area.

While the tape is under tension provided by the cooperation of the bar and the wind up surface, the operator may manually remove leading bag 38 from the tape. Typically, the operator peels the bag from the tape, thereby requiring less force than if the bag is stripped from the tape by a shearing action caused by attempting to drag the bag along and ultimately from the tape. Peeling may be effected by gradually stripping the bag from the tape by pulling upwardly on the bag starting at the edge of the upper lip, that is the lip of the bag surface which is not adhered to the tapes and pulling the bag from and lifting the bag backwardly away from the tape until bag removal is completed. In a packaging operation the operator removing the bags may also load a product into each removed bag, such as loading meat in a meat packaging plant. After loading or otherwise disposing of a first removed bag, the operator next removes the successive bag 40 with or without turning the handle or otherwise advancing the tapes in the wind up operation.

By suitably mounting the device on the housing, an appropriate display area may be provided for displaying at least two and preferably three, four, five or more bags in the tensioned bag removal area intermediate the wind up surface and the bar. For any given chain of imbricated bags the length of the display area required from the device to the bar to permit initially displaying a plurality of bags will depend on the length of the bag and the distance of offset of each successive bag on the tape or tapes.

After the last readily accessible bag in the display area is removed or sooner if desired, the operator turns the handle to rotate the shaft, plate and connecting rods or other surface defining means, thereby winding up or accumulating more wound up tape on the surface and advancing a next bag or set including a plurality of bags into the display area for subsequent removal.

The provision of the clutch in the present device or other suitable means for permitting rotation of the surface in a first direction and substantially precluding rotation in the opposite direction imparts a number of advantages. A main advantage of the clutch is that the operator can remove a bag without inducing any substantial unwinding of the wound up tape portions, which if did happen would typically slow down the removal operation due to difficulties in removing a bag from a tape not in relatively taut condition provided by the tensioning effects of the present dispensing system. These and other difficulties are substantially avoided by use of the present device, especially when included in combination with a housing as described. For example another difficulty, often encountered with heretofore known dispensing systems, which is substantially avoided by the present device is the difficulty of removing bags when not in the relatively straight bag alignment typically effected using the present device.

Still another drawback of prior art wind up devices is that wind up proceeds in a skewed manner with the tapes haphazardly and disorderly arranged about the surface, resulting in great difficulty in removing accumulated tape. The present device has the added advantage, especially when the surface winding means includes at last three rods or other means for providing a generally polygonal surface having at least three sides, that in the event of misalignment of the tapes being wound up, which may result from, for example deviations from truly linear arrangement or parallelism of the tapes, the device is found to automatically realign the bags in the display area and to realign the wound up portions of the tapes. In general, the resulting improved alignment of wound up tape portions facilitates subsequent removal of the accumulated tape from the wind up surface. When it is desired to remove the wound up tape from the surface, for example after dispensing and removing all bags in one chain of imbricated bags, the operator may remove the tape using any one or more of the above described procedures therefor. Other tape removal procedures may also be used.

For improved continuity in operation the dispensing system may include a plurality of apparatuses 10. An arrangement of two or more such apparatuses is also included within the spirit and scope of this invention. Such arrangements provide additional versatility which may be required for improved efficiency in various packaging applications. For example each combination of the device with the housing may be operated using bags of different sizes from one combination to another. An operator may thereby select a bag of one size for one product to be loaded and thereafter select a different size bag for a different size product, without need for interruption of his loading duties.

The present process may be carried out with or without using dispensing apparatus including the herein illustrated and described wind up device. Various tape removal steps may include cutting the accumulated and wound up tape. Where the tape is wound up on a wind up device having a wind up surface of a first perimeter and an adjoining region of a second perimeter larger than the first perimeter, the removing step may include effecting relative displacement between the wind up region and the adjoining region to provide a clearance and removing the accumulated tape through the clearance. Such a clearance is illustrated in FIG. 2 and described in the above description.

The tape removal step may further include decreasing the perimeter of the wind up region to decrease friction between the accumulated tape and the wind up surface, and displacing the accumulated tape along the decreased perimeter until the tape is free of the wind up surface.

Apparatus 10 may include a display member such as a support sheet for supporting the bags in the bag removal area shown in FIG. 1 above the wind up surface and extending backwardly therefrom in the FIGURE. The display member may appear as a downwardly tapering, preferably rigid, support sheet of metal or other suitable material. The sheet may be fastened to the apparatus by, for example, securing an end thereof to the support member or bar 16. Such a support sheet is shown in FIG. 13 by support or display member 80, which as shown therein includes a turned end, which provides a convenient but not essential means for attaching the display member to the housing of the apparatus.

Figure 13:
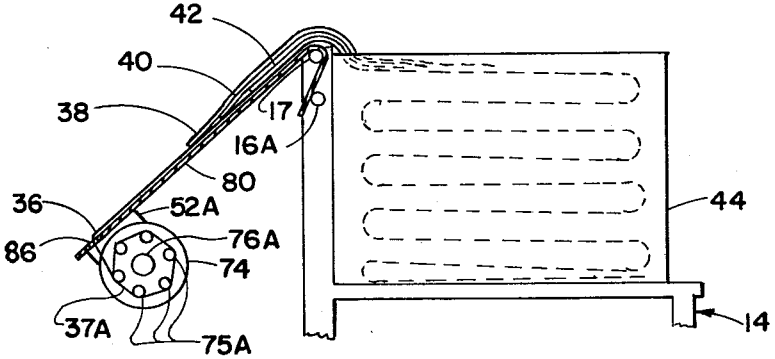
FIG 13 is a fragmentary sectional side elevation view of the device of FIG. 12, taken along line 13—13.
Figure 12:
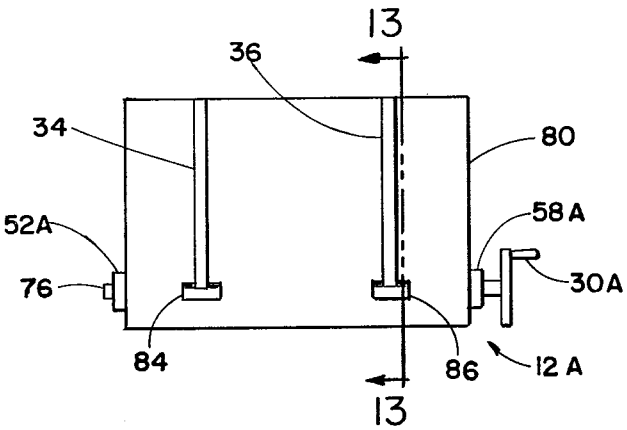
FIG. 12 is a top plan view illustrating another embodiment of the device.

Another embodiment of the present device is shown in FIGS. 12–13 by device 12A which may be identical or similar to the device 12, except having the features next described. This embodiment device is provided with display member 80 which may be a support sheet and preferably includes openings or holes 84 and 86 through the member near an end thereof disposed generally above the wind up surface as shown in FIG. 13. Device 12A includes arms 52A and 58A secured to the support sheet and depending therefrom. Either or both of these arms may include a clutch assembly having a clutch, as previously described and shown by clutch assembly 60 and clutch 62 (FIG. 9) for performing the same function. Arms 52A and 58A may be provided with through holes for receiving a through shaft 76A, upon which may be mounted at opposite end regions thereof two plates illustrated by carrier plate 74. These plates may be concentrically or eccentrically mounted on the shaft. The wind up surface may be generally hexagonally prismatic as shown and defined by hexagonally disposed rods 75A. Operation of this device may be generally as above described. However, in this embodiment where the optional slots are included the tapes 34 and 36 are received through the slots in passing from the display area to the wind up surface wherein they are accumulated as indicated by tape accumulation 37A in FIG. 13.

For greater clarity the bags connected to the tape are not shown in FIG. 12.

Figure 15:
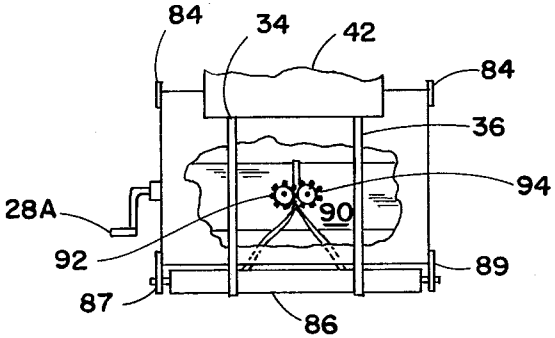
FIG. 15 is a plan view of the device of FIG. 14 except including a pair of gears in lieu of a roller thereof.
Figure 14:
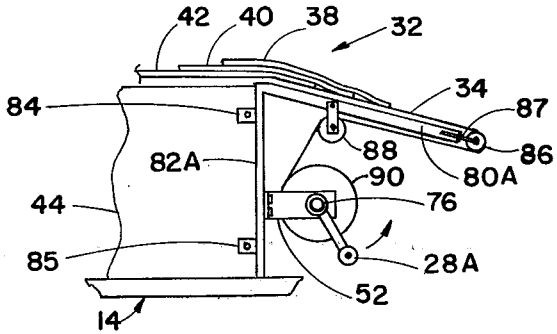
FIG. 14 is a side view illustrating another embodiment of the device.

Another embodiment of the present device is shown in FIGS. 14 and 15. Embodiment device 12B therein illustrated includes display and support sheet 80A and wind up surface 90 operably connected thereto for winding up adhesive support means or tapes 34 and 36. The wind up surface is disposed relative to the support 80A such that the chain of imbricated bags may be advanced to a display area defined by preferably downwardly tapering support sheet 80A for removal of the bags sequentially as by an operator and the spent or remaining tape pulled around the end of the support sheet and wound up on the wind up surface. The relative disposition is preferably as illustrated with the wind up surface disposed below the support sheet and preferably recessed from the end thereof further away from the supply or box 44 of the taped imbricated bag supply chain. The wind up surface may be the cylindrical surface of a cylinder mounted on shaft 76 which may extend through the cylinder and be received in holes provided in opposite circular end plates of the cylinder, the plates serving as carriers for the wind up surface. The display support includes an upright turned end 82A constituting a body to which the wind up surface is connected for operably connecting the support sheet to the wind up surface. Device 12A desirably further includes means for attaching the device either to a box or other supply of taped bags as shown or to a housing adapted to hold the supply. One such means is illustrated by clips 84 and 85 which may be secured as by fastening means to the box 44.

In operation of device 12A for dispensing bags from chain 32, leading ends of the one or more tapes 34 and 36 are pulled from the supply downwardly atop the support sheet, around roll 86 mounted at the free end of the support sheet by connecting arms 87 and 89, preferably next around or through guide means, and then secured to the wind up surface by any suitable means, a number of which are described above. The guide means may include roller 88 extending transversely of a width of the support sheet and disposed thereunder with arms supportingly connecting ends of the roller in rotatable manner to the support sheet as shown. The wind up surface, which may be connected to the body 82A by arms 52 (one shown in FIG. 14) fastened as an end thereof by a fastening means to the body and rotatably receiving shafts 76 through holes in the arms at opposite ends thereof. One or both of these arms may be provided with a clutch assembly such as clutch assembly 60A having a clutch 62 (see FIG. 9) for permitting wind up of the tape in rotational direction illustrated by the arrow in FIG. 14 and for substantially precluding unwinding or reversed directional rotation of the wind up surface. In another aspect the device may include a pair of gears 92 and 94 mounted for substantially intermeshing engagement, permitting one or more tape strands 34 and 36 to pass between the nip of the gears. If desired one or more of the gears may be provided with clutch means serving the function described for clutch assembly 60 to the extent that the tapes may thereby be maintained in tension from the supply source to the gears. When desired, as for example after removing one or more bags from the tape in the display area above the support sheet, the tape is wound up about the wind up surface by rotating handle 28A, thereby advancing a chain portion including one or more additional bags to the display area and winding up an accumulation of spent tape from which bags have previously been removed. If desired roll 88 may be adjustably mounted by means well known in the art for controlling the tension in the tape. In FIG. 15 the chain of bags is shown with leading and next bags 38 and 40 removed and a portion of the support sheet shown by the fragmentary line removed for greater clarity. In FIG. 14 the chain of bags, the supply box thereof and the housing are shown in fragmentary illustration for simplicity.

Figure 17:
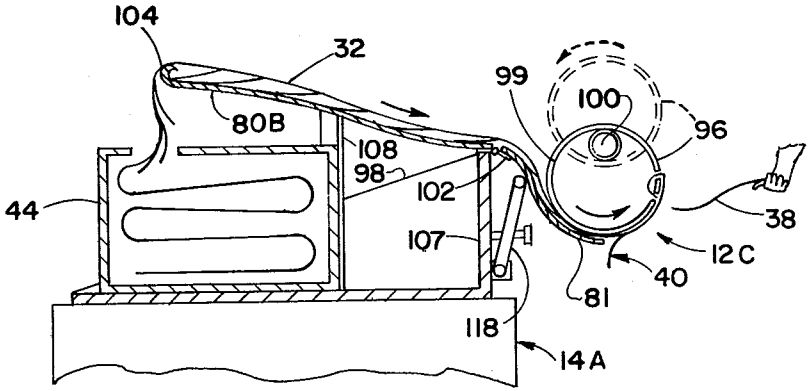
FIG. 17 is a fragmentary sectional view of the device of FIG. 16 taken along line 17—17 thereof. The embodiment device shown in FIGS. 16–17 includes a rotatable sleeve for winding up one or more strands.
Figure 16:
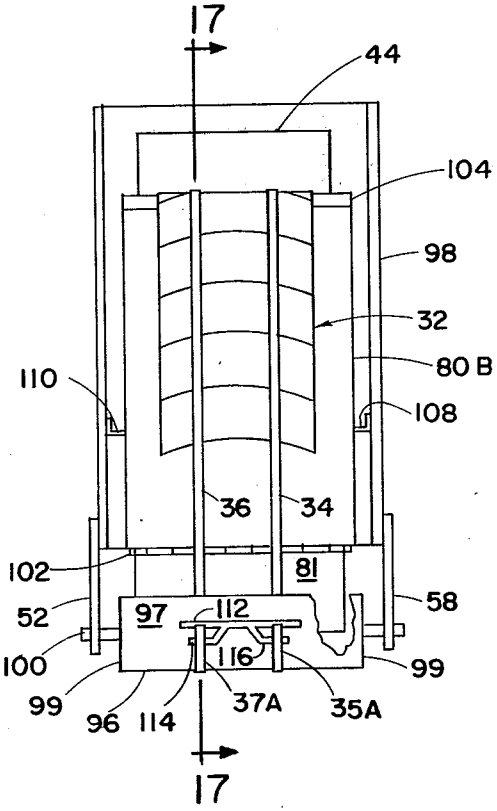
FIG. 16 is a top plan view illustrating yet another embodiment of the device with a chain of taped bags being advanced into position for removal from the tape.

In FIGS. 16 and 17 there is shown another embodiment of the present device, wherein the strand or tape wind up surface is provided by a rotatable sleeve or hollow cylinder. Therein is shown device 12C including freely rotatable annular or hollow cylinder 96 which is eccentrically supported by rod 100 extending through the hollow core of the cylinder. The cylinder has a cylindrical wind up surface 97 and opposite annular wall ends 99 between which the surface extends. As illustrated, device 12C includes support or frame 98 which may be of generally rectangular shape in plan view for receiving box 44 or other supply of chain 32 of imbricated taped bags. Opposite ends of the rods are mounted, preferably non-rotatably mounted, in holes in spaced apart arms 52 and 58 which may be attached to walls of frame 98 or to other support structure. The device includes support sheet 80B on which the bag chain may be supported and displayed, the sheet having sheet end 81 which may be generally S-shaped as shown, with an arcuate end disposed below the annular cylinder. The arcuate end is spaced from the surface 97 of the cylinder by an amount sufficient to permit passage of the bag chain therebetween. The S-shaped sheet end may be pivotally connected to the other portion of the support sheet as by means of hinge 102 and desirably is provided with lever assembly 118 for supporting the sheet end and for adjusting the spacing between the cylinder and the sheet end portion. The frame may include wall 107 for supporting the sheet as at the hinged sheet area and upright 108 and 110 spaced from the wall 107 for supporting the sheet at other portions thereof. If desired the sheet may include a turn portion 104 at the end opposite the hinged portion for guiding the passage of the chain of imbricated bags thereover in a bag dispensing operation. The cylinder is desirably provided with main slot 112 and one or more parallel slots 114 and 116 communicating with the main slot. The slots aid in start up operation by providing a passageway through which one or more tapes 34 and 36 may be secured to the cylinder by looping a leading end of each tape therethrough as shown in FIG. 17 with the end of the tape extending, for example, in looped manner described in greater detail below.

In operation of the device 12C, a chain of imbricated bags 32 is withdrawn at its leading end and pulled about turn portion 104 of support or sheet 80B with the bags lying below the tape and supported at free portions thereof by the underlying sheet. Preferably the tape strands are non-tacky or relatively tack-free on the exposed surfaces thereof opposite the tape surface having portions adhered to the bags. The leading end of the chain is pulled from the turn portion 104 along the support 80B, between the cylinder and arcuate hinged sheet end 81, partially around the cylinder, over slots 114 and 116 either of them, through slot 112 over the inner cylindrical surface and radially outward through either one or both of slots 114 and 116 and either clockwise or counterclockwise as viewed from the side shown in FIG. 17 under the now formed tape loop. Next the resulting adjacent tape surfaces are pressed together against the cylindrical surface to secure the lead end of the chain to the cylinder or wind up surface. If desired the cylinder may be rotated one or more revolutions about the eccentric rod 100 to more firmly secure the tape to the cylinder, and as may be required to advance the leading bag such that its connected end is advanced passed the transverse edge of sheet end 81 and into a position for removal of the bag from the tape. Bag 40 depending from the tape as shown in FIG. 17 illustrates a bag in such position for removal. Sequential bag removal and intermittently advancing of the bag chain may now be initiated. A bag in position for removal may be removed by grasping an end thereof as illustrated by hand grasped bag 38 shown in FIG. 17 directly after its removal from the tape.

It is found that a jerking action of the hand is highly effective to remove bags from the tape and effects movement from the cylinder away from the support end 81; and by suitable follow through the jerking action effects rotation of the cylinder 360 degrees about rod 100, thereby advancing a next or following bag into position for removal as illustrated by bag 40 in FIG. 17. Exposed tacky tape surfaces 35A and 37A are found to aid in bag removal of the tapes without distending the tape from the cylinder by adherence of the tacky surfaces to portions of the tape 34 and 36 brought into contact therewith upon sufficient rotation of the cylinder. Complete or substantially 360° rotation is found to be sufficient. For example, the non-tacky surface opposite the tape portion to which bag 40 is secured is found to adhere to the wound tape intermediate the wind up surface and the tape portion to which the bag is adhesively secured. By initially pulling the bag downwardly away from the wind up surface and then jerking upwardly the bag is typically found to be easily and substantially immediately removed with a resulting 360° rotation of the cylinder. By suitably positioning the wind up cylinder with sufficient spacing from support end 81, typically with a slight pressure applied on intervening bags by the support end and the cylinder, typically with minimum if any clearance between the intervening bag and the support end and the cylinder, sufficient tension is thereby created or maintained on the tape portion from which a secured bag is to be removed, with minimum if any resulting movement of the tape portions secured to the bag from the wind up surface or underlying accumulated wound up tape.

Preferably the cylinder is formed of sufficiently heavy construction such that the slight pressure referred to above is readily achieved. The circumference of the cylinder is desirably of a length substantially equal in length to the spacing of each bag from a next bag on the chain.

The spacing between support end 81 and cylinder 96 is typically found to permit rotation of the wind up surface in the direction shown by the arrow and to substantially preclude rotation of the wind up surface in the opposite or clockwise direction when viewed as shown in FIG. 17. Support and spacing adjustment means illustrated by the lever assembly 118 is a preferred means for permitting and substantially precluding cylinder rotation as described above.

Figure 18:
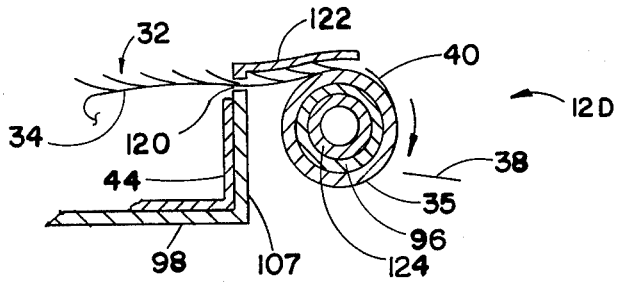
FIGS. 18–19 are fragmentary side sectional views of other embodiments of the present device including rotatable sleeves useful for winding up carrier tape by jerking bag removal action.

FIG. 18 illustrates another embodiment device of the present invention. Therein shown is embodiment device 12D in side sectional elevation view. The device includes frame 98 having upstanding wall 107 provided with an elongate hole 120 disposed transversely therethrough. A pressure member such as generally rectangular plate 122 is provided and may be generally flat or slightly arcuate as shown. Plate 122 which may be connected to the frame as illustrated atop wall 107, extends away from the frame and over annular cylinder 99 which is rotatably mounted or received about fixed cylindrical core 124 which may be solid or annular as shown. The fixed cylindrical core may be supported at opposite ends thereof by well known support means, not shown, such as for example by connecting arms 52 and 58 to the frame as shown in FIG. 16.

In operation of device 12D chain 32 of taped imbricated bags is withdrawn at a leading end thereof from box 44 or other supply, passed through elongate hole 120 under rectangular plate 122, and partially around and secured by any suitable means to the cylindrical wind up surface of annular cylinder 96. The leading end of the chain is so withdrawn as to have the imbricated bags above one or more tapes 34 and between the tape and the generally rectangular plate. After the chain of bags is secured to the wind up surface and advanced as by winding up a sufficient amount such that at least the leading edge of one bag is advanced sufficiently to permit ready access to such bag, illustrated by the position of bag 40 in FIG. 18, the bag may be grasped and removed as by manually grasping and jerking radially outwardly and preferably slightly downwardly to remove the bag as illustrated by removed bag 38. It is found that the bag removal action rotates the cylinder 96 and winds up successive portions of tape about the cylinder. By appropriately jerking with sufficient force and in an appropriate direction, typically as above described, the bag removal action typically rotates the cylinder 360 degrees about the fixed cylindrical core and comes to rest at such position. Preferably plate 122 is formed of slightly flexible and resilient construction such that the space between the plate and the wound up tape may be easily adjusted to maintain slight pressure on the chain of bags passing between the plate and the wind up surface or accumulated tape. Such pressure is found to aid in substantially precluding inadvertent rotation of the wind up cylinder in a counterclockwise direction when viewed as shown in FIG. 18. When desired, the accumulated tape may be severed or otherwise removed from the wind up cylinder. Alternatively the wind up surface and accumulated tape may be removed from the cylindrical core 124 and merely disposed of. In this manner of operation the annular cylinder 96 is replaced with a like annular cylinder to permit continued operation of the device.

Figure 19:
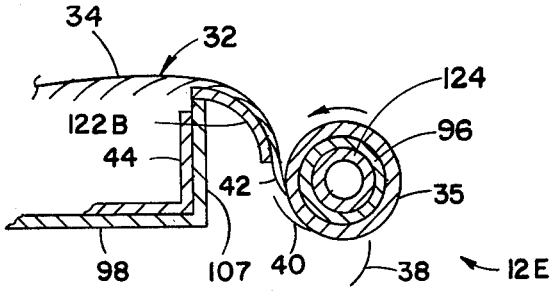

FIG. 19 illustrates another embodiment device of the present invention. As shown therein device 12E, which in many respects is similar or substantially identical to device 12D of FIG. 18, includes frame 98 having wall 107 to which is connected near an upper end thereof one end of a pressure member or generally arcuate rectangular plate 112B, which has a free end spaced generally horizontally from cylindrical core 96. In comparison to device 12D, the device shown in FIG. 19 is adapted for oppositely directed rotational movement with the chain of imbricated bags disposed such that the depending bags are below the tape 34. With the exception of the oppositely directed preferred rotation of the wind up cylinder, the operation of device 12D and 12E is substantially similar.

Figure 20:
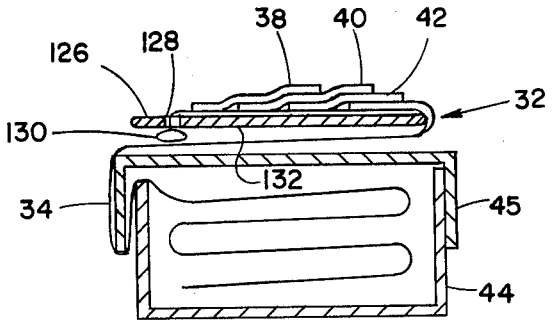
FIG. 20 is a schematic side sectional view of a chain of taped bags wherein the tape end is secured to an invertable support.

FIG. 20 schematically shows the chain 32 of imbricated bags illustrated by bags 38, 40 and 42 secured at ends thereof to a tacky surface of tape strand 34. The chain is packaged in box 44 having lid 45 which preferably fits over the box in relatively snug engagement therewith. For clarity exaggerated clearance is shown at the left side of the box in FIG. 24 for passage of the chain between the lid and the box and between the lid and support 126 having the chain secured thereto. An end portion of tape 34 is secured to an end portion of the support by any suitable means, for example a ball 130 of tape wound upon itself and having a diameter larger than the diameter of hole 128 which extends through the support. The chain may include one or more additional strands of tape as illustrated by tape strands 34 and 36 of FIG. 1.

In order to permit removal of a leading bag from the tape, the support is preferably disposed as schematically illustrated atop lid 45 with a portion of the chain extending therebetween for holding the intermediate tape portion and substantially preventing disruption of the illustrated chain alignment on the support. The bags may be sequentially removed by, for example hand grasping an open leading end, the trailing end or other suitable portion of the bag, and pulling the bag from the connected tape. When the bags, e.g. bags 38, 40 and 42 have been removed from the tape, the support may be inverted end over end, thereby winding more tape and connected bags about the support and presenting a new set of bags tensioned engagement through the tape to the support on surface 132 thereof. By intermittently inverting the support and removing the resulting readily accessible bags from the tape, the entire supply of bags may be readily removed, as be hand, from the tape, thereby depleting the supply chain and accumulating the tape or tapes in spirally wound manner about the support sheet. If desired the lid may be dispensed with and the support mounted atop the box 44 or against any suitable surface for holding the chain of bags against the support 126. The support may include one or more holes illustrated by holes 84 and 86 in FIG. 12. Conveniently the bags may be opened and removed in one operation by grasping the bag between the lips of the mouth and thereafter jerking or otherwise removing the bag. This manner of removing the bags facilitates and increases the speed fo a loading operation which may be performed by an operator.

The foregoing description of the present invention is given by way of illustration with an awareness that numerous modifications may be made therein without departing from the spirt or scope of the invention.

What is claimed is:

1. A device comprising a. a first carrier, b. means for rotatably mounting the carrier to permit rotation of the carrier about an axis of rotation, c. means defining a surface adapted to rotate in response to rotation of the carrier to wind-up at least one flexible support, d. means for permitting rotation of the surface in a first rotational direction and for substantially precluding rotation of the surface in a direction opposite to the first direction, and e. a second carrier spaced from and opposite said first carrier, said surface-defining means extending from one of said carriers to the other of said carriers, and means for permitting relative displacement of at least one of said carriers away from said surface-defining means.

2. The device of claim 1 wherein said surface is adapted for contraction of a perimeter thereof.

3. The device of claim 1 wherein said surface is of low friction composition.

4. The device of claim 1 wherein said means for permitting relative displacement includes a resilient member adapted to normally bias said one carrier and said surface-defining means into engagement with each other.

5. The device of claim 1 wherein said surface includes surface regions of at least two spaced apart elongate members.

6. The device of claim 5 wherein said surface includes surface regions of at last three spaced apart elongate members, the lateral extend of the surface having a generally polygonal section.

7. The device of claim 1 further including pivot means for permitting angular displacement of said surface between first and second zones.

8. Apparatus comprising the device of claim 1, in combination with a housing adapted to support a supply chain of receptacles successively and removably attached to at least one flexible support.

9. The apparatus of claim 8 further including a member adapted to cooperate with said device to place tension on a first portion of said flexible support extending from said member to a second portion of said flexible support wound about said surface.

10. The device of claim 1 further including a handle adapted to effect rotation of said surface.

11. The device of claim 1 further including a display support adapted to display and support at least a portion of a supply chain having a flexible support and one or more articles removably secured to said flexible support, said display support disposed such that the flexible support portion of the chain can be passed over the display support and wound up on the wind up surface.

12. A chain comprising

A. a flexible support having an end portion,

B. a plurality of articles removably secured to said flexible support and successively disposed thereon, and C. winding and holding means secured to said end portion for winding said flexible support into a wound position about said means and for holding a so wound portion of said flexible support under sufficient tension such that one or more of said articles may be removed from the wound portion of the flexible support by hand grasping and pulling the article to be removed, said winding and holding means comprising a first carrier and a second carrier, means defining a surface for rotation in response to the rotation of said carriers, said surface-defining means extending from one of said carriers to the oher of said carriers, and including means for permitting relative displacement of at least one of said carriers away from said surface-defining means.

13. The chain of claim 16 wherein the winding and holding means is a generally planar support adapted to be manually inverted end-over-end.

14. A process for sequentially removing flexible receptacles from a chain including the receptacles adhered to at least one flexible support, which comprises:

A. withdrawing a portion of the flexible support from a supply,

B. securing the withdrawn portion to a wind up surface,

C. rotating the surface when the flexible support is secured thereto to a. withdraw a chain portion including at least one receptacle from the supply, b. wind up a portion of the flexible support, and c. create tension on the withdrawn chain portion including at least one receptacle, D. while the chain portion is under the tension, removing at least one receptacle from the tensioned chain portion, E. repeating steps (C) and (D) for successive portions of the chain to sequentially remove a plurality of the receptacles, thereby accumulating a wound-up flexible support portion, and F. removing the accumulated flexible support portion from the wind up surface by decreasing the perimeter of said wind-up region to decrease friction between said accumulated flexible support portion and said wind-up surface, and removal is affected by displacing the accumulated tape along the decreased perimeter.

15. A process for sequentially removing flexible receptacles from a chain including the receptacles adhered to at least one flexible support, which comprises:

withdrawing a portion of the flexible support from a supply;

securing the withdrawn portion to a wind up surface;

rotating the surface when the flexible support is secured thereto to a. withdraw a chain portion including at least one receptacle from the supply, b. wind up a portion of the flexible support, and c. create tension on the withdrawn chain portion including at least one receptacle;

removing at least one receptacle from the tensioned chain portion;

repeating said steps of rotating and removing for successive portions of the chain to sequentially remove a plurality of the receptacles, thereby accumulating a wound-up flexible support portion; and removing the accumulated flexible support portion from the wind up surface and wherein the surface includes a wind up region having a first perimeter and an adjoining region having a second perimeter, said second perimeter being larger than said first perimeter and said removing step includes separating said wind up region from said adjoining region to provide a clearance and removing said accumulated flexible support through said clearance.

16. A process for sequentially removing flexible receptacles from a chain including the receptacles adhered to at least one flexible support, which comprises:

withdrawing a portion of the flexible support from a supply;

securing the withdrawn portion to a wind up surface;

rotating the surface when the flexible support is secured thereto to a. withdraw a chain portion including at least one receptacle from the supply, b. wind up a portion of the flexible support, and c. create tension on the withdrawn chain portion including at least one receptacle;

removing at least one receptacle from the tensioned chain portion;

repeating said steps of rotating and removing for successive portions of the chain to sequentially remove a plurality of the receptacles, thereby accumulating a wound-up flexible support portion; and removing the accumulated flexible support portion from the wind up surface by severing said accumulated flexible support into a plurality of sections thus causing said accumulated flexible support to disengage itself from said wind up surface.

* * * * *